United States Patent [19]

Monderer et al.

[11] Patent Number: 5,022,237

[45] Date of Patent: Jun. 11, 1991

[54] ATTACHMENT APPARATUS TO REMOVABLY RETAIN A CHARM ON A BRACELET WITHOUT OBSTRUCTING THE VIEW OF GEMSTONES ON THE BRACELET

[75] Inventors: Thea B. Monderer, Los Angeles; Ruben Flores, Hawthorne, both of Calif.

[73] Assignee: Superior Diamond Corporation, Los Angeles, Calif.

[21] Appl. No.: 475,953

[22] Filed: Feb. 6, 1990

[51] Int. Cl.[5] ..... A44C 25/00

[52] U.S. Cl. ..... 63/23; 63/31; 63/2

[58] Field of Search ..... 63/23, 29.1, 31, 2, 63/11

[56] References Cited

U.S. PATENT DOCUMENTS

| | | | |
|---|---|---|---|
| 242,946 | 6/1881 | Lochner | 63/11 |
| 3,114,187 | 12/1963 | Wayne | 63/2 X |
| 4,530,221 | 7/1985 | Weinberg | 63/2 |

FOREIGN PATENT DOCUMENTS

| | | | |
|---|---|---|---|
| 448731 | 2/1913 | France | 63/31 |
| 1443118 | 5/1966 | France | 63/2 |
| 964294 | 7/1964 | United Kingdom | 63/2 |

*Primary Examiner*—Laurie K. Cranmer
*Attorney, Agent, or Firm*—Thomas I. Rozsa

[57] ABSTRACT

A jewelry finding or attachment means by which a charm is attached to a bracelet. The particular attachment means enables the charm to be removably attached at any desired location along the length of the bracelet at a location where the charm will be fully visible while at the same time not obscuring the upper surface of the bracelet and therefore not obstructing the view of any of the gemstones in the top surface of the bracelet. The attachment means further provides a safe and secure attachment with dual safety features to assure that the attachment and charm will not come loose and fall off the bracelet.

9 Claims, 1 Drawing Sheet

Fig. 1.
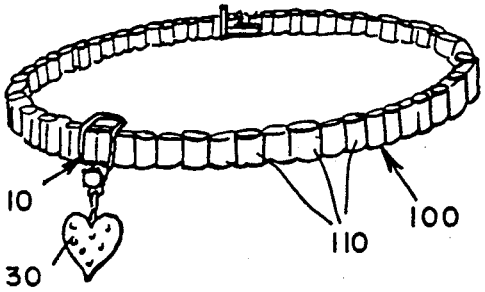
Fig. 2.
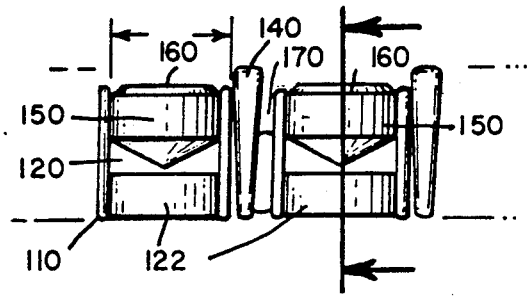
Fig. 3.
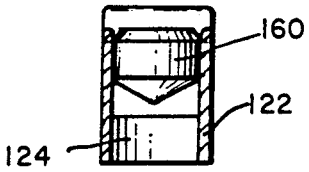
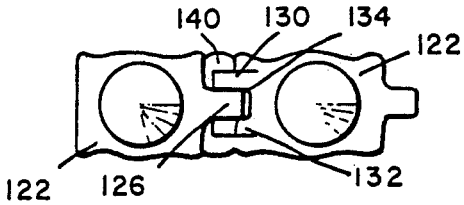
Fig. 4.
Fig. 5.
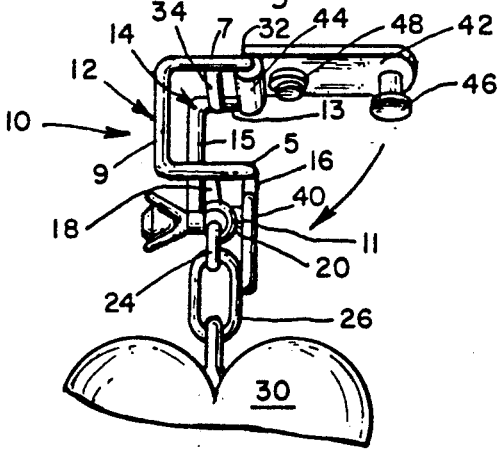
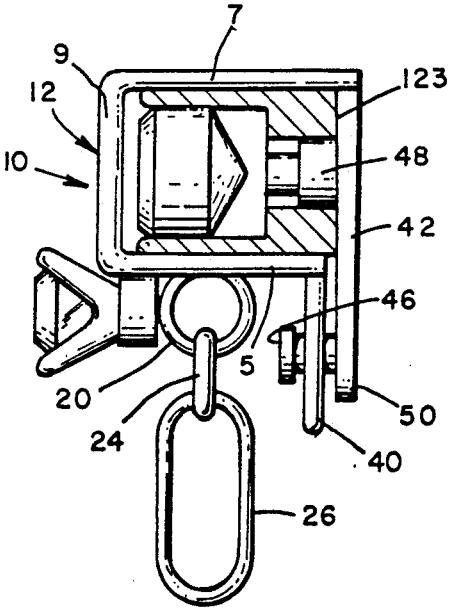
Fig. 6.
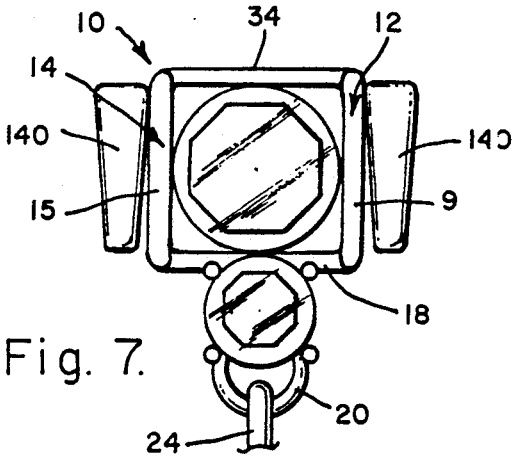
Fig. 7.

ATTACHMENT APPARATUS TO REMOVABLY RETAIN A CHARM ON A BRACELET WITHOUT OBSTRUCTING THE VIEW OF GEMSTONES ON THE BRACELET

BACKGROUND OF THE INVENTION

1. Field of the Invention

The present invention relates to the field of jewelry findings and in particular to attachment means which are used to retain a charm on a bracelet.

2. Description of the Prior Art

In general, jewelry findings which are used to retain a charm on a bracelet are comprised of clasps and various hook arrangements by which the charm is retained on the bracelet. In most conventional attachment means, the attachment is fixed and the charm can only be located at a preselected place on the bracelet. In embodiments where the attachment means are located adjacent the interior surface of the bracelet, the charm is somewhat obstructed from view. In embodiments where the attachment is placed closer to the top or exposed surface of the bracelet, the attachment may obscure a portion of the top surface.

Therefore, there is a significant need for a finding or charm attachment means which can removably retain a charm on a bracelet in a manner which permits the attachment and the charm to be placed at any desired location along the length of the bracelet and further attaches the charm in a manner wherein it is fully visible while at the same time not obscuring a portion of the top surface of the bracelet.

SUMMARY OF THE PRESENT INVENTION

The present invention is a jewelry finding or attachment means by which a charm is attached to a bracelet. The particular attachment means enables the charm to be removably attached at any desired location along the length of the bracelet at a location where the charm will be fully visible while at the same time not obscuring the upper surface of the bracelet and therefore not obstructing the view of any of the gemstones in the top surface of the bracelet. The attachment means further provides a safe and secure attachment with dual safety features to assure that the attachment and charm will not come loose and fall off the bracelet.

It has been discovered, according to the present invention that a pair of spaced apart generally parallel U-shaped members can be fitted over a bracelet and locked in placed beneath the bracelet to thereby provide a retaining means which will not obscure the upper surface of the bracelet. Such a retaining means thereby therefore support a charm to hang from the bracelet and can be located at any desired point along the length of the bracelet.

It has further been discovered that use of a rotatable locking arm and female mating member arrangement serves to securely lock the generally U-shaped retaining member in place on the bracelet.

It is therefore an object of the present invention to provide a retaining means which can removably lock a charm at any desired location on a bracelet in a manner such that the retaining means will not obscure the upper surface of the bracelet.

It is a further object of the present invention to provide a secure retaining means with additional remain in a fixed orientation on the bracelet.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a diagrammatic sketch in perspective of a bracelet with the present invention attachment apparatus in its operative position on the bracelet and retaining a charm thereon.

FIG. 2 is a side elevational view of two adjacent links of the bracelet illustrated in FIG. 1.

FIG. 3 is a cross-sectional view taken along line 3—3 of FIG. 2.

FIG. 4 is a bottom plan view of two adjacent links of the bracelet illustrated in FIG. 1.

FIG. 5 is a perspective view of the present invention attachment means shown in the open position.

FIG. 6 is a side elevational view in partial cross-section of the present invention attachment means shown in the closed position.

FIG. 7 is a top plan view of the present invention attachment means attached on the bracelet illustrated in FIG. 1.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIG. 1 there is illustrated at 100 one type of bracelet with which the present invention attachment means can be used. Referring to both FIGS. 1 and 2, the bracelet 100 comprises a multiplicity of links 110. Each link has a stone mounting member 120 having a lower section 122 and an upper section 150. The upper section 150 serves as a mounting to retain a gemstone 160 which by way of example may be a diamond. As illustrated in FIG. 3, lower section 122 is hollow and includes a central opening 124. As illustrated in FIG. 4, one lower section 122 is joined to an adjacent lower section 122 by means of a tongue and groove arrangement, with a tongue 126 on one lower section inserted into an adjacent mating member on the adjacent lower section, the mating member having a pair of sidewalls 130 and 132 and an accommodating groove 134 to receive the tongue 126 which are then interconnected by conventional means such as a pin. A vertical wall member 140 surrounds the tongue and groove intersection members and serves to separate one mounting member from an adjacent mounting member 120. A small gap 170 exists between a separating wall 140 and the body of the lower section 122 and upper section 150 of an adjacent mounting member 120.

The present invention removable attachment means 10 is illustrated in detail in FIGS. 5 through 7. The attachment means 10 comprises a pair of spaced apart inverted generally "U" shaped bridge members 12 and 14. Bridge member 12 has a first longitudinal wall 5, a parallel second longitudinal wall 7 and a transverse wall 9 which connects first longitudinal wall 5 to second longitudinal wall 7. Similarly, bridge member 14 has a first longitudinal wall 11, a parallel second longitudinal wall 13 and a transverse wall 15 which connects first longitudinal wall 11 to second longitudinal wall 13. The bridge members 12 and 14 are attached by a first crossbar 16 at the tips of their respective first longitudinal walls 5 and 11. The crossbar extends at approximately 90 degrees to each transverse wall 9 and 15. Bridge members 12 and 14 are also attached by a second crossbar 18 which also serves to support a link 20. Second crossbar 18 is parallel to and spaced apart from first crossbar 16 and also connects first longitudinal wall 5 with first longitudinal wall 11. Link 20 serves as an attachment means to retain an interconnecting link 24 which in turn is connected to a charm retaining link 26 and thereby serves to attach the charm 30 to the removable attachment means 10. First crossbar 16 also supports a transverse female section 40 of a locking clasp 50, which extends transversely to the crossbar 16 and is generally parallel and spaced apart from support link 20.

The bridge members 12 and 14 are also attached by a third crossbar 32 at the tips of their respective second longitudinal walls 7 and 13. The crossbar extends at approximately 90 degrees to each transverse wall 9 and 15. Crossbar 32 is also parallel to crossbar 16. Bridge members 12 and 14 are also attached by a fourth crossbar 34 which is spaced apart from third crossbar 32 and also connects second longitudinal wall 7 with second longitudinal wall 13. Third crossbar 32 also rotatably supports the arm and locking pin of the clasp member 50. Arm 42 comprises a hollow cylindrical attachment member 44 adjacent one end which is rotatably affixed on third crossbar 32. Arm 42 further comprises a locking pin 46 adjacent its opposite end which locking pin is inserted into transverse female section 40 for the purpose of locking the removable attachment means 10. Arm 42 also comprises a stabilizing pin 48 located between the hollow cylindrical attachment member 44 and locking pin 46 which is configured to be at the approximate mid-width location intermediate bridge member 12 and 14 and also at the mid-width area of each bridge so as to be generally centered in the area of the tips of the vertical walls of the pair of bridges 12 and 14 when the locking pin 48 is mated with the transverse female section 40.

The bridge members 12 and 14 are configured so that each bridge member 12 and 14 rests over the location of the gap 170 between a vertical wall member 140 and the adjacent end of a mounting means 120. The four longitudinal walls 5, 7, 11 and 13 extend over and adjacent the outside of the upper section 150 and lower section 122 of mounting means 120 while the two transverse walls 9 and 15 are aligned over a respective gap 170 and adjacent a vertical wall 140 so that the gemstone 160 is clearly visible between the two transverse walls 9 and 15. In this orientation, transverse female member 40 extends away from a sidewall of a mounting means 120 and arm 42 is rotated so that it is flush with the bottom surface 123 of a lower section 122 as illustrated in FIG. 6. The locking pin 46 is then inserted into transverse female member 40 to thereby lock the removable attachment member 10 onto the bracelet 100. Stabilizing pin 48 fits into opening 124 of lower section 122 of mounting means 120 to further assure that bridge members 12 and 14 are stabilized to either side of mounting means 120 and thereby assure that the gemstone 160 will be clearly visible between the bridge members 12 and 14.

It will be appreciated that through the present invention novel attachment apparatus, the charm 30 which can be of any desired size and configuration can be mounted in a secure manner at any desired location along the length of the bracelet 100. In addition to being mounting securely at any desired location, the attachment means is mounted on the bracelet in such a manner so as not to obscure the top of the bracelet and not to obscure the attractive gemstone about which the attachment means is mounted.

The present invention has been described for use in connection with the bracelet illustrated in the drawings but it will be appreciated that it can be used to removably lock a charm on any bracelet having a top, body and bottom. While the present invention is especially enhanced when the bracelet includes a gemstone, it will be appreciated that it is not necessary for the bracelet to include a gemstone and merely the view of the upper surface of the bracelet is benefitted from the "U" shaped design of the attachment member.

Therefore, the present invention can be defined as an apparatus for retaining a charm on a bracelet having a top surface, body and bottom surface, comprising: (a) a bridge member having a first generally "U" shaped member comprising a first longitudinal wall and a second longitudinal wall connected at one end by a transverse wall and a second generally "U" shaped member comprising a first longitudinal wall and a second longitudinal wall connected at one end by a transverse wall with the first and second generally "U" shaped members spaced apart from each other such that their respective first longitudinal walls are parallel, their respective second longitudinal walls are parallel and their respective transverse walls are parallel; (b) an attachment means comprising an elongated bar rotatably connected at one end to the two first longitudinal walls and having one mating attachment member affixed to and extending transversely from the two second longitudinal walls whereupon rotation to the closed position causes the elongated bar to lie flush against the ends of the two first and two second walls and lie parallel to the two transverse walls when the two mating attachment members are locked together; and (c) means for retaining a charm attached to said bridge member such that the charm is supported to hang from said bridge member; (d) whereby the bridge member is inserted over said bracelet such that the two transverse walls rest on the top surface of the bracelet while the two first longitudinal walls and two second longitudinal walls extend over the body of the bracelet and said elongated bar is rotated to be aligned flush with the bottom of the bracelet and after being locked with the two mating attachment members serves to retain the apparatus on the bracelet while the charm hangs from the apparatus.

Defined more broadly, the present invention is an apparatus for retaining a charm on a bracelet having a top surface, body and bottom surface, comprising: (a) a bridge member having a pair of spaced apart generally parallel inverted generally "U" shaped members; (b) an attachment member rotatably connected at one end to said bridge member whereupon rotation to the closed position causes the attachment member to lie flush against the open end of the pair of spaced apart generally parallel inverted generally "U" shaped members; (c) a mating attachment means extending transversely from the end of said bridge member remote from the rotatable attachment of said attachment member wherein said attachment member is removably locked in place upon rotatable connection to said mating attachment means; and (d) means for retaining a charm attached to said bridge member such that the charm is supported to hang from said bridge member; (e) whereby the bridge member is inserted over said bracelet such that the closed portion said pair of spaced apart inverted generally "U" shaped members rests on the top surface of the bracelet while the remainder of the bridge member extends over the body of the bracelet and said attachment member is rotated to be aligned flush with the bottom of the bracelet and after being locked with said mating attachment means serves to retain the apparatus on the bracelet while the charm hangs from the apparatus.

The present invention attachment apparatus can be made of any suitable material for example: (1) precious metal such as gold, silver, or platinum, (2) other metals such as tin or brass, or (3) non-metallic materials such as plastic.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for retaining a charm on a segment of given length of a bracelet, where the bracelet segment has a top surface with ornament and a bottom surface with an opening, comprising:

a. a bridge member generally configured by two substantially U-shaped frames, where each U-shaped frame has a first longitudinal wall and a second longitudinal wall, each having a first end and a second end and connected by a transverse wall at their second ends, and the two U-shaped frames are connected spaced apart in parallel by a first cross bar at the two respective first ends of the two first longitudinal walls and a second cross bar at the two respective first ends of the two second longitudinal walls, such that the space between the two U-shaped frames is about the same as the length of the bracelet segment;

b. a thin elongated clasp member having an inner surface and a flat outer surface and a first end and a second end, and rotatably attached to the first cross bar of said bridge member at its first end, and further comprising a first mating means at its inner surface adjacent to its second end, such that when rotated into a closing position the inner surface of the clasp member lies flush against the four respective first ends of the two first and two second longitudinal walls and parallel to the two transverse walls of said bridge member;

c. a mating member affixed to and transversely extending from the second cross bar of said bridge member, and further comprising a second mating means; and d. a retaining means affixed to said bridge member for retaining a charm, such that the charm is supported to hang from said bridge member;

e. whereby when said bridge member is placed over the bracelet segment such that the two transverse walls of said bridge member are adjacent to the top surface of the bracelet segment, said clasp member can be rotated into the closing position to be adjacent to the bottom surface of the bracelet segment, and the first mating means of said clasp member can be locked with the second mating means of said mating member, to thereby retain the apparatus on the bracelet segment while the charm hangs from the apparatus and the ornament on the top surface of the bracelet segment is visible between the two transverse walls of said bridge member of the apparatus.

2. An apparatus in accordance with claim 1 wherein said retaining means comprises a first member affixed to the two first longitudinal walls of said bridge member and a second member interconnecting the first member and the charm.

3. An apparatus in accordance with claim 2 wherein the second member of said retaining means is a link.

4. An apparatus in accordance with claim 1 wherein the first mating means of said clasp member is a connecting pin protruding from the inner surface of said clasp member, and the second mating means of said mating member is a receiving loop accommodating the connecting pin.

5. An apparatus in accordance with claim 1 wherein said clasp member further comprises a stabilizing pin protruded from the inner surface of said clasp member which is inserted into the opening at the bottom surface of the bracelet segment when the apparatus is retained on the bracelet.

6. An apparatus for retaining a charm on a bracelet having a top surface and a bottom surface, comprising:

a. a bridge member generally configured by two substantially U-shaped frames connected in parallel and each having two parallel longitudinal walls connected by a transverse wall;

b. a thin clasp member having an inner surface and a generally flat outer surface and rotatably attached to said bridge member, and further comprising a first mating means, such that when rotated into a closing position the clasp member is generally parallel to the two transverse walls of said bridge member and forms a closed enclosure with said bridge member; and c. said bridge member further comprising a retaining means for retaining a charm and a second mating means;

d. whereby when said bridge member is placed over the bracelet such that the two transverse walls of said bridge member is adjacent to the top surface of the bracelet, said clasp member can be rotated into the closed position such that the inner surface of said clasp member is adjacent to the bottom surface of the bracelet, and the first mating means of said clasp member can be locked with the second mating means of said bridge member, to thereby retain the apparatus on the bracelet while the charm is retained on the apparatus.

7. An apparatus in accordance with claim 6 wherein said retaining means comprises a first member affixed to the two U-shaped frames and a second member interconnecting the first member and the charm.

8. An apparatus in accordance with claim 7 wherein the second member of said retaining means is a link.

9. An apparatus in accordance with claim 6 wherein the first mating means of said clasp member is a connecting pin protruding from the inner surface of said clasp member, and the second mating means of said mating member is a receiving loop accommodating the connecting pin.

* * * * *